US005361828A

United States Patent [19]

Lee et al.

[11] Patent Number: 5,361,828

[45] Date of Patent: Nov. 8, 1994

[54] SCALED HEAT TRANSFER SURFACE WITH PROTRUDING RAMP SURFACE TURBULATORS

[75] Inventors: Ching-Pang Lee, Cincinnati; Joseph W. Savage, Maineville; Melvin Bobo, Cincinnati, all of Ohio

[73] Assignee: General Electric Company, Cincinnati, Ohio

[21] Appl. No.: 19,238

[22] Filed: Feb. 17, 1993

[51] Int. Cl.[5] ..... F28F 13/12

[52] U.S. Cl. ..... 165/109.1; 165/133

[58] Field of Search ..... 165/109.1, 133

[56] References Cited

U.S. PATENT DOCUMENTS

| | | | |
|---|---|---|---|
| 2,488,615 | 11/1949 | Arnold | 165/109.1 X |
| 3,628,885 | 12/1971 | Sidenstick . | |
| 4,180,373 | 12/1979 | Moore et al. . | |
| 4,236,870 | 12/1980 | Hucul, Jr. et al. . | |
| 4,278,400 | 7/1981 | Yamarik et al. . | |
| 4,416,585 | 11/1983 | Abdel-Messeh . | |
| 4,443,389 | 4/1984 | Dodds . | |
| 4,470,452 | 9/1984 | Rhodes . | |
| 4,474,532 | 10/1984 | Pazder . | |
| 4,514,144 | 4/1985 | Lee . | |
| 4,515,526 | 5/1985 | Levengood . | |
| 4,534,409 | 8/1985 | Cadars . | |
| 4,537,647 | 8/1985 | Foster . | |
| 4,577,681 | 3/1986 | Hughes . | |
| 4,627,480 | 12/1986 | Lee . | |
| 4,668,443 | 5/1987 | Rye . | |
| 4,727,907 | 3/1988 | Duncan | 165/109.1 X |
| 4,872,578 | 10/1989 | Fuerschbach et al. . | |
| 4,997,036 | 3/1991 | Schulze et al. . | |
| 5,052,889 | 10/1991 | Abdel-Messeh . | |
| 5,070,937 | 12/1991 | Mougin et al. | 165/133 |
| 5,156,362 | 10/1992 | Leon . | |

FOREIGN PATENT DOCUMENTS

| | | | |
|---|---|---|---|
| 68554 | 6/1979 | Japan | 165/133 |
| 84093 | 5/1984 | Japan | 165/109.1 |
| 86389 | 5/1985 | Japan | 165/109.1 |
| 998021 | 7/1965 | United Kingdom | 165/109.1 |
| 2112467 | 12/1981 | United Kingdom . | |

OTHER PUBLICATIONS

"Compact Heat Exchangers", R. K. Shah, A. D. Kraus, D. Metzger, Hemisphere Publishing Corp., pp. 151–167.

"The Effect of Rib Angle And Length On Convection Heat Transfer In Rib-Roughened Triangular Ducts", D. E. Metzger, R. P. Vedula and D. D. Breen, Arizona State University, pp. 327–333.

"Improved Methods For Determining Heat Transfer" by Samuel D. Spring, The Leading Edge, Winter 1987/1988.

"Augmented Heat Transfer In Square Channels With Parallel, Crossed, and V-Shaped Angled Ribs", by J. C. Han and Y. M. Zhang, ASME Journal of Heat Transfer, Jun., 1990.

*Primary Examiner*—Stephen M. Hepperle

*Attorney, Agent, or Firm*—Jerome C. Squillaro; Nathan D. Herkamp

[57] ABSTRACT

A heat transfer surface for use along a flowpath along the surface is scaled with rows of turbulators having ramp surfaces protruding into the flowpath operable to generate turbulence promoting vortices. The ramp surfaces may be oriented to present an upward or downhill ramp to the direction of the flowpath along the surface. The present invention is further characterized by triangular side surfaces which precipitous drop off from a top ramp surface to the base of the turbulator along the heat transfer surface. The preferred embodiment of the present invention provides a three sided pyramid shaped turbulator with a ramp downhill surface wherein the sharp edge at the intersection of the two precipitous side surfaces is a leading edge into the flowpath on the heat transfer surface. Alternate embodiments include turbulators with triangular and rectangular uphill ramp surfaces.

10 Claims, 2 Drawing Sheets

SCALED HEAT TRANSFER SURFACE WITH PROTRUDING RAMP SURFACE TURBULATORS

BACKGROUND OF THE INVENTION

1. Field of the invention

This invention relates to turbulators on a heat transfer surfaces in a flowpath that are used to generate vortex induced turbulence to enhance heat transfer across the surface.

2. Description of Related Art

It is well known to use turbulence promoting vortex generators, often referred to as turbulators (such as fins, ribs, pins, twisted tapes, inserts, etc.), in heat transfer apparatuses and systems to increase surface heat transfer rate or performance. Heat exchanger applications that are of particular importance to the present invention have flow passages such as tubes and channels. Turbulator enhanced heat transfer devices using ribbed annular tubes have been developed to produce turbulent flows in high temperature gas cooled nuclear reactor applications. Turbulators for use in internal cooling airflow passages of hot gas turbine engine turbine blades typically are in the form of pins and ribs.

Turbulence promoting ribs have been commonly used inside the modern turbine airfoil to generate more turbulence and enhance the internal heat transfer coefficient. The rib generally has a small and square cross section ($0.011 \times 0.011$) and a 0.111 pitch spacing. The rib can be oriented either perpendicular or angled to the flow direction. It is cast as an integral part of the airfoil. Due to the wear of the core die during the casting process, the height and shape of the rib will vary and affect its heat transfer performance. Therefore, it is important to have a surface which not only can produce effective turbulences to enhance heat transfer but also can tolerate more wear of the core die.

It is well known to use turbulator ribs that are continuous and broken and straight and angled. The use of turbulators to enhance heat transfer, however, can cause significant pressure drops across the channel or other airflow passage. It is therefore also of great importance to have a heat transfer surface that can better augment heat transfer and cause a smaller pressure drop than is conventionally available.

SUMMARY OF THE INVENTION

According to the present invention a heat transfer surface for use along a flowpath along the surface is scaled with rows of turbulators having ramp surfaces protruding into the flowpath from the surface and operable to generate turbulence promoting vortices. The ramp surfaces may be oriented to present an upward or downhill ramp to the direction of the flowpath along the surface. The present invention is further characterized by triangular side surfaces which precipitous drop off from a top ramp surface to the base of the turbulator along the heat transfer surface.

A first particular embodiment provides a scaled surface having an array of longitudinally extending rows of laterally spaced apart wedge shaped turbulators. The wedge shaped turbulators have rectangular ramp surfaces. Preferably the wedge shaped turbulators are all of the same shape and within each row are spaced apart by the laterally extending width of the wedge shaped turbulator. The width is preferably disposed essentially perpendicular to the flowpath. The preferred embodiment has wedge shaped turbulators that are laterally disposed between the wedge shaped turbulators in adjacent rows such that wedge shaped turbulators in alternating rows are longitudinally aligned.

Another embodiment provides a scaled surface having an array of longitudinally extending rows of laterally adjacent three sided pyramid shaped turbulators protruding into the flowpath that have triangular ramp surfaces. The turbulator's shape is a substantially right angle pyramid wherein the top surface is the triangular ramp surface and there are two triangular side surfaces distending from the ramp surface perpendicular to the triangular base of the turbulator. In one embodiment the turbulator base triangles of adjacent rows are longitudinally aligned while in another they are laterally offset in an array wherein the turbulator base triangles of alternating rows are longitudinally aligned. Preferably the lateral offset is one half the turbulator width.

The preferred embodiment of the present invention provides a three sided pyramid shaped turbulator with a ramp downhill surface wherein the sharp edge at the intersection of the two precipitous side surfaces is a leading edge into the flowpath on the heat transfer surface. This embodiment may also be arrayed as longitudinally aligned or laterally offset by one half the turbulator width.

ADVANTAGES

The present invention provides a turbulator design which provides for the use of a durable core die during the casting process. The advantage of such a durable design is to resist the wear of the core die during the casting process so that the height and shape of the turbulators will not vary by a significant enough degree and affect its heat transfer performance. Therefore, the present invention has the advantage of providing a heat transfer surface that produces effective turbulences to enhance heat transfer and is more effectively cast so as to sustain more wear of the core die.

Another advantage of the present invention is that the scales surface can be more easily cast on the internal surface of a cooling passage on both pressure and suction sides. The present invention produces small eddies that are continuously generated to cover the entire surface which is more advantageous than the periodic vortex shedding produced in conventional turbulator rib designs. This provides a more efficient heat transfer process requiring less cooling air than conventional rib designs.

Another advantage of the scaled surface of the present invention is that it can take some mechanical loads unlike the turbulator ribs which are generally dead weights to airfoil. Because the ramps have less sharp corners there is less corner stresses.

The foregoing, and other features and advantages of the present invention, will become more apparent in the light of the following description and accompanying drawing.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
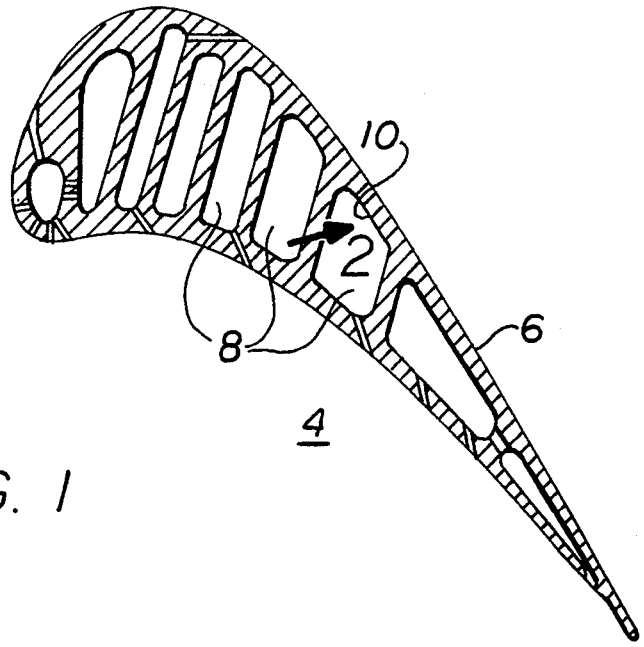
FIG. 1 is cross-sectional view of an air cooled gas turbine engine turbine airfoil as an exemplary application of a scaled heat transfer surface having an array of turbulators having ramp surfaces protruding into the flowpath in accordance with one embodiment of the present invention.

Illustrated in FIG. 1 is cross-sectional view of an air cooled gas turbine engine turbine airfoil 4 having an outer wall 6 which in part bounds cooling airflow passages 8. The airfoil 4 serves as an exemplary application of a heat transfer surface 10 on the wall 6 along a flowpath within the cooling airflow passage 8.

Figure 2:
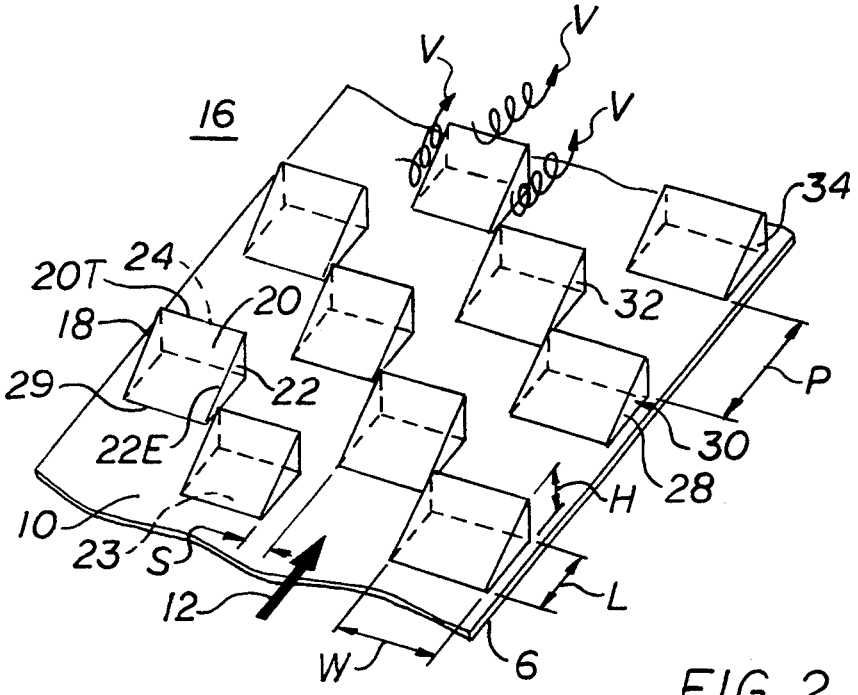
FIG. 2 is a perspective of a scaled heat transfer surface having an array of wedge shaped turbulators in accordance with one embodiment of the present invention.

FIG. 2 illustrates a flowpath 12 along the heat transfer surface 10 of the wall 6 and shows flowpath 12 as an arrow in the downstream and longitudinal direction. The heat transfer surface 10 is scaled with an array 16 of protrusions in the form of wedge shaped rectangular turbulators 18 in accordance with one embodiment of the present invention. The wedge shaped rectangular turbulators 18 are preferably all substantially identical in shape and size and have rectangular uphill ramp surfaces 20 protruding into the flowpath 12 from the heat transfer surface 10. The wedge shaped rectangular turbulator 18 have steep drop off side surfaces 22 and a steep drop off aft facing surface 24 extending from the top ramp surface 20 to a base 23 defined by a projection of the top ramp surface on the heat transfer surface 10 of the turbulator. This feature of the rectangular turbulator 18 generates turbulence promoting vortices V that scrub the heat transfer surface 10. By definition the uphill ramp surface 20 is oriented to present an uphill ramp to the direction of the flowpath 12 along the surface 10.

The embodiment illustrated in FIG. 2 provides a scaled heat transfer surface 10 having a preferred array 16 of longitudinally extending rows 28 of laterally spaced apart wedge shaped turbulators 18. Preferably the wedge shaped turbulators 18 are all of the same shape and sizes and within each row 28 are laterally spaced apart by the laterally extending width W of a wedge edge 29 between the top ramp surface 20 and the base 23 of the turbulator. The width W is preferably disposed essentially perpendicular to the flowpath 12. The preferred embodiment has wedge shaped turbulators 18 that are laterally disposed between the wedge shaped turbulators in adjacent rows such as a first row 30 and a second row 32. Furthermore, such that wedge shaped turbulators in alternating rows, such as first 30 and a third row 34, are longitudinally aligned and spaced a distance S apart. This effectively provides a lateral offset between adjacent rows of turbulators equal to the wedge shaped turbulator width W.

For one example of the present invention as illustrated in FIGS. 1 and 2 the turbulator height H is approximately 0.021 inches and the turbulator length L and inter-row spacing P is approximately 8 to 10 times H. The rectangular turbulators 18 are offset in adjacent rows to take advantages of edge effects of side surfaces 22 which generate more vortices V in addition to those generated by the steep drop off the aft facing surface 24. The flow on the ramp surface 20 will first accelerate along the uphill ramp surface and at the same time shed small vortices V from the side edges 22E of the ramp surface 20. At the top 20T of the ramp surface 20 the boundary layer is interrupted to form a stronger vortex off the aft facing surface 24.

Figure 4:
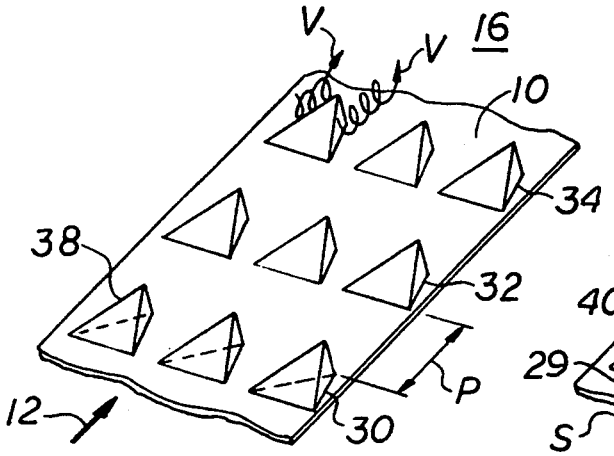
FIG. 4 is a perspective of a scaled heat transfer surface having a longitudinally aligned array of three sided pyramid shaped turbulators.
Figure 3:
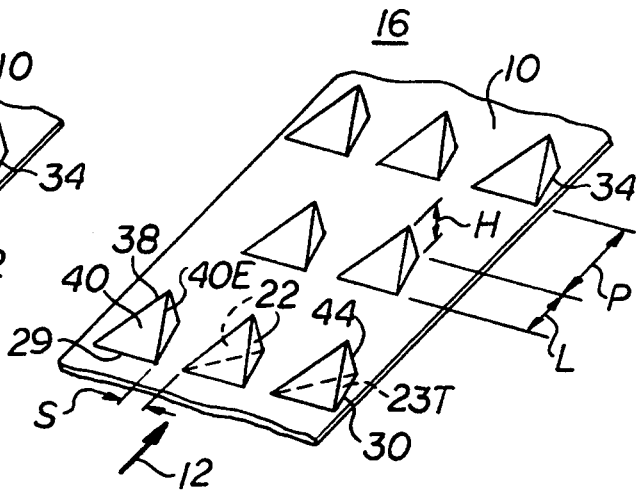
FIG. 3 is a perspective of a scaled heat transfer surface having a laterally offset array of three sided pyramid shaped turbulators.

Illustrated in FIGS. 3 and 4 is another embodiment which provides a heat transfer surface 10 that is scaled with an array 16 of three sided pyramid shaped turbulators 38. The three sides are a top triangular ramp surfaces 40 and two side surfaces 22. For the purposes of this patent the base is not referred to as a surface. The pyramid shaped turbulators 38 are preferably all substantially identical in shape and size and have triangular ramp surfaces 40 protruding into the flowpath 12 from the heat transfer surface 10. The pyramid shaped turbulators 38 illustrated in the FIGS. are substantially right angle pyramids and have steep drop off side surfaces 22 that are operable to generate turbulence promoting vortices V. The pyramid shaped turbulators 38 culminate in a steep drop off aft facing corner 44. The triangular uphill ramp surface 40 is oriented to present an uphill ramp to the direction of the flowpath 12 along the surface 10. The flow on the triangular ramp surface 40 will first accelerate along the uphill triangular ramp surface and at the same time shed vortices V from the side edges 40E of the triangular ramp surface. The preferable shape of the pyramid shaped turbulator 38 is substantially a right angle pyramid wherein the top surface is the triangular ramp surface and there are two triangular side surfaces distending from the ramp surface perpendicular to a triangular base 23T of the pyramid shaped turbulator 38. The pyramid shaped turbulators 38 in a given row are spaced apart a distance S between adjacent wedge edges 29 of the triangular bases 23T. The turbulator height H, as in the example above, may be approximately 0.021 inches and the turbulator length L and inter-row spacing P is approximately 8 to 10 times H. In FIG. 4 the triangular bases 23T of adjacent rows are longitudinally aligned while in FIG. 3 they are laterally offset in an array wherein the turbulator base triangles of alternating rows are longitudinally aligned. Preferably the lateral offset is one half the distance between corners 44 of laterally adjacent pyramid shaped turbulators 38.

Figure 5:
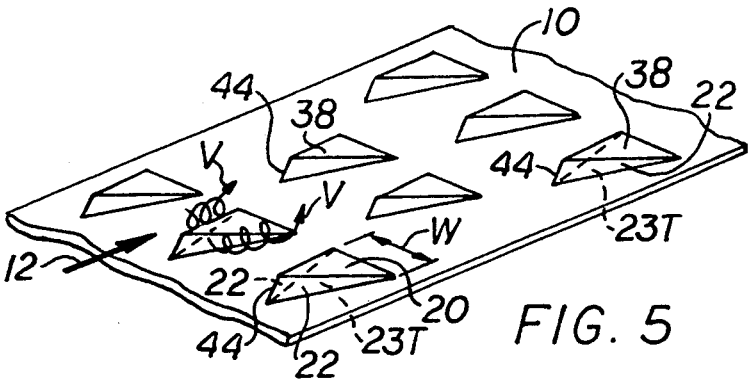
FIG. 5 is a perspective of a preferred embodiment of a scaled heat transfer surface having a laterally offset array of three sided pyramid shaped turbulators having a leading edge into the flowpath between the sides of the pyramid.
Figure 6:
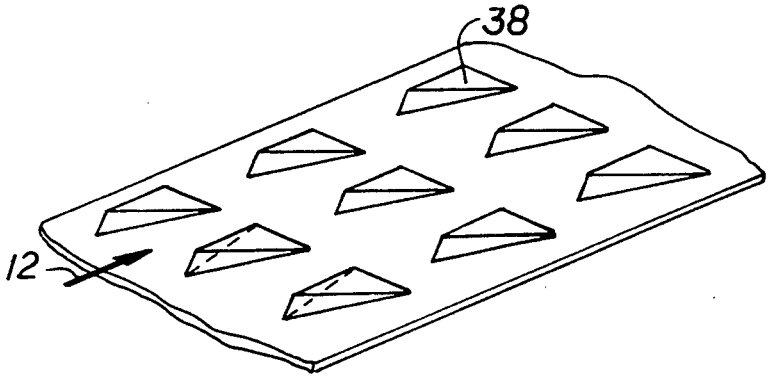
FIG. 6 is a perspective of a preferred embodiment of a scaled heat transfer surface having a longitudinally aligned array of three sided pyramid shaped turbulators having a leading edge into the flowpath between the sides of the pyramid.

Illustrated in FIGS. 5 and 6 are preferred embodiments of the present invention having three sided pyramid shaped turbulators 38 as in FIGS. 3 and 4 but turned around with respect to the flow so that the corner 44 formed by the two side surfaces 22 is a leading edge facing into the flow path 12. Experimental results have shown that this embodiment provides better heat transfer results than the other embodiments in FIGS. 2 through 4. The preferred embodiment of pyramid shaped turbulator 38 has a downhill sloping ramp surface 20 and a leading edge corner 44 and is operable to generate turbulence promoting vortices V along the side surfaces 22 and scrub the heat transfer surface 10.

In FIG. 6 the triangular bases 23T of adjacent rows are longitudinally aligned while in FIG. 5 they are laterally offset in an array wherein the turbulator base triangles of alternating rows are longitudinally aligned. Preferably the lateral offset is one half the distance between corners 44 of laterally adjacent pyramid shaped turbulators 38.

While the preferred and an alternate embodiment of the present invention has been described fully in order to explain its principles, it is understood that various modifications or alterations may be made to the preferred embodiment without departing from the scope of the invention as set forth in the appended claims.

We claim:

1. A device for generating vortices which promote turbulence along a heat transfer wall which is operable to transfer heat between a flowpath along the wall, said device comprising:

a scaled heat transfer surface on the wall, an array of scales on said scaled heat transfer surface, said array comprising a plurality of longitudinally disposed rows of laterally disposed and spaced apart turbulators, each of said turbulators having a top ramp surface protruding into the flowpath from said surface, two triangular side surfaces precipitously dropping off from said top ramp surface to a base defined by a projection of said ramp surface on said heat transfer surface of said turbulator.

2. A device as claimed in claim 1 wherein said ramp surface is triangular in shape and has a width along a wedge edge of said triangular ramp surface and said base wherein said wedge edge is perpendicular to an aft facing downstream direction of the flowpath.

3. A device as claimed in claim 2 further comprising a corner edge rising sharply upward from said heat transfer surface and formed by an intersection of said two triangular side surfaces.

4. A device as claimed in claim 3 wherein;

said ramp surface ramps downhill in an aft facing downstream direction of the flowpath, said corner edge is a leading edge of said triangular side surfaces, and said corner edge is longitudinally forward of said wedge edge wherein said wedge edge is a trailing edge of said ramp surface.

5. A device as claimed in claim 4 wherein said turbulators in longitudinally adjacent rows of said turbulators have said corner edges that are laterally offset by one half the distance between said corner edges of laterally adjacent ones of said turbulators and are aligned in alternating ones of said rows.

6. A device as claimed in claim 3 wherein;

said ramp surface ramps uphill in an aft facing downstream direction of the flowpath, said wedge edge is a leading edge of said ramp surface, and said wedge edge is longitudinally forward of said corner edge and said corner edge is a trailing edge of said triangular side surfaces.

7. A device as claimed in claim 6 wherein said turbulators in longitudinally adjacent rows of said turbulators have said corner edges that are laterally offset by one half the distance between said corner edges of laterally adjacent ones of said turbulators and are aligned in alternating ones of said rows.

8. A device as claimed in claim 1 wherein said ramp surface is rectangular in shape and ramps uphill in an aft facing downstream direction of the flowpath and each of said turbulators further comprise an aft facing back surface between said ramp surface and said base.

9. A device as claimed in claim 2 wherein said back surface precipitously drops off from said top ramp surface to said base.

10. A device as claimed in claim 9 wherein said turbulators in longitudinally adjacent rows of said turbulators have said are laterally offset by at least one half the width of said ramp surface and are aligned in alternating ones of said rows.

* * * * *